US005226726A

United States Patent [19]

Chen

[11] Patent Number: 5,226,726

[45] Date of Patent: Jul. 13, 1993

[54] FOLDABLE LANTERN FRAME

[76] Inventor: W. T. Chen, No. 17, Alley 18 Lane 27, Kuang Hwa Street, Hsin-Chu City, Taiwan

[21] Appl. No.: 730,277

[22] Filed: Jul. 12, 1991

[51] Int. Cl.[5] ..... F21V 1/06

[52] U.S. Cl. ..... 362/352; 362/353; 362/357; 362/450

[58] Field of Search ..... 362/352, 353, 357, 358, 362/388, 450, 162, 393

[56] References Cited

U.S. PATENT DOCUMENTS

| | | | |
|---|---|---|---|
| 369,737 | 9/1987 | Ray | 362/162 |
| 5,034,868 | 7/1991 | Stelfox et al. | 362/352 |

FOREIGN PATENT DOCUMENTS

| | | | |
|---|---|---|---|
| 221699 | 5/1910 | Fed. Rep. of Germany | 362/162 |
| 48404 | 7/1909 | Switzerland | 362/162 |

*Primary Examiner*—Stephen F. Husar

*Attorney, Agent, or Firm*—James A. Drobile; Robert E. Rosenthal

[57] ABSTRACT

A foldable lantern comprises a frame body (10) composed of two crossed base members (11) each having at its two ends a corner post retaining hole (111) and at its middle a center post retaining hole (112). A center post (22) with it reduced diameter section (23) passing through the holes (112) makes the two base members (11) to be able to pivot each other to cause the frame body (10) extendible and foldable. The center post (22) with its upper end extended to become a lamp holder (20). The cross members having four corner posts (12) inserted with their upper sections (121) serving as a tightener of a tent or screen (50) while the lower section (122) as leg for upstanding of the lantern (10). A hanger ring (24) is provided at the bottom of the frame for hanging up-side-down of the lantern whenever called for. Stopper means is provided along side the cross member to prevent them from over extending.

10 Claims, 5 Drawing Sheets

FOLDABLE LANTERN FRAME

The present invention relates generally to a decorative lantern and more particularly to a foldable lantern comprises a frame body composed of two crossed base members with four corner posts upstanding to be wrapped around by an endless loop of tent to form a screened lantern. Said two crossed base members being pivoted at center by a reduced diameter lower section of a lantern socket holding post so that the lantern is capable of being collapsed and folded up when not in use to save storage and shipping space.

Of such type a lantern, two major design key points shall have to be borne in mind, the one is in the aesthetic point of view while the other is related to the practicality. Being a decorative lantern, to look good of course is of great importance which seems to belong to the job of an artist. As for the practicality, a simple and reliable structure that provides fool-proof operation and unobstructive performance.

Conventional foldable lantern of this type possess a couple of drawbacks so far as the structure is concerned. In one respect, when the lantern is in a rest position whether it is extended or folded, it fails to maintain an exact and constant pose, since the crossed base members tend to slip one over the other. Means serves to keep the frame stand still is absolutely needed once it is fully extended or completely folded-up. A second drawback is the loosening of the loop tent when the fabric composed becomes slack when being fatigued, which in turn results in a louse image that entirely jeopardizes the purpose of being decorative.

SUMMARY OF THE INVENTION

Therefore a prime object of the present invention is to provide a foldable lantern, of which the structure is simple and steady and would keep the frame assuming a firm pose whether it is in an extended or a folded position. Stopper means is hence provided to serve such a purpose when the lantern frame is fully extended or completely folded-up. The stopper alongside the cross member should hamper the slippage of one member over the other.

Another object of the present invention is to provide a lantern frame of which the four corner posts where the ten wraps over are all outwardly inclined so that tent wrapped there-around would be tightened up to give a looking of good spirit. This is fulfilled by inserting a wedge means in-between the base member end hole and the corner post.

Still another object of the present invention is to provide a decorative lantern that would help to give rise to the festival atmosphere by way of having the screen of the lantern made of colorful fabric and/or with unique pattern designed thereupon to meet various occasions of celebration.

A still further object of the present invention is to provide a foldable lantern which is erectly standable and also suspendible up-side-down. The downwardly extended four corner posts serves as legs for upright stand not even on a rigid ground but on a sot surface. A hanger ring disposed under the crossed base member is for the inverted hanging up of the lantern.

A further object of the present invention is to provide a lantern frame of which the cross base members having a central pivot provided by a central post which upwardly extended to become a lamp socket holder.

Other objects and features would become apparent from the following detailed description of the preferred embodiments accompanying with the annexed drawings therefor.

The following is a component list showing all the parts involved to facilitate the detailed description of the embodiments.

COMPONENT LIST (LANTERN FRAME)

10 Frame body
- 11 base member, rectangular
- 111 retaining hole, corner post
- 112 retaining hole, center post
- 113 stopper
- 114 wedge corner post
- 121 tenting section
- 122 leg section

20 lamp holder
- 21 socket retainer
- 22 center post
  - 221 retaining flange
  - 222 retaining washer
- 23 reduced diameter section
  - 231 anchoring hole for hanger ring
- 24 hanger ring
  - 241 ends of the ring
- 24' hanger, inverted "V" shaped

30 lighting socket
- 31 bulb seat
- 32 conductor
- 33 hook

40 light bulb
- 41 bulb proper
- 42 bulb base

50 tent

DESCRIPTION OF THE PREFERRED EMBODIMENTS

Figure 1:
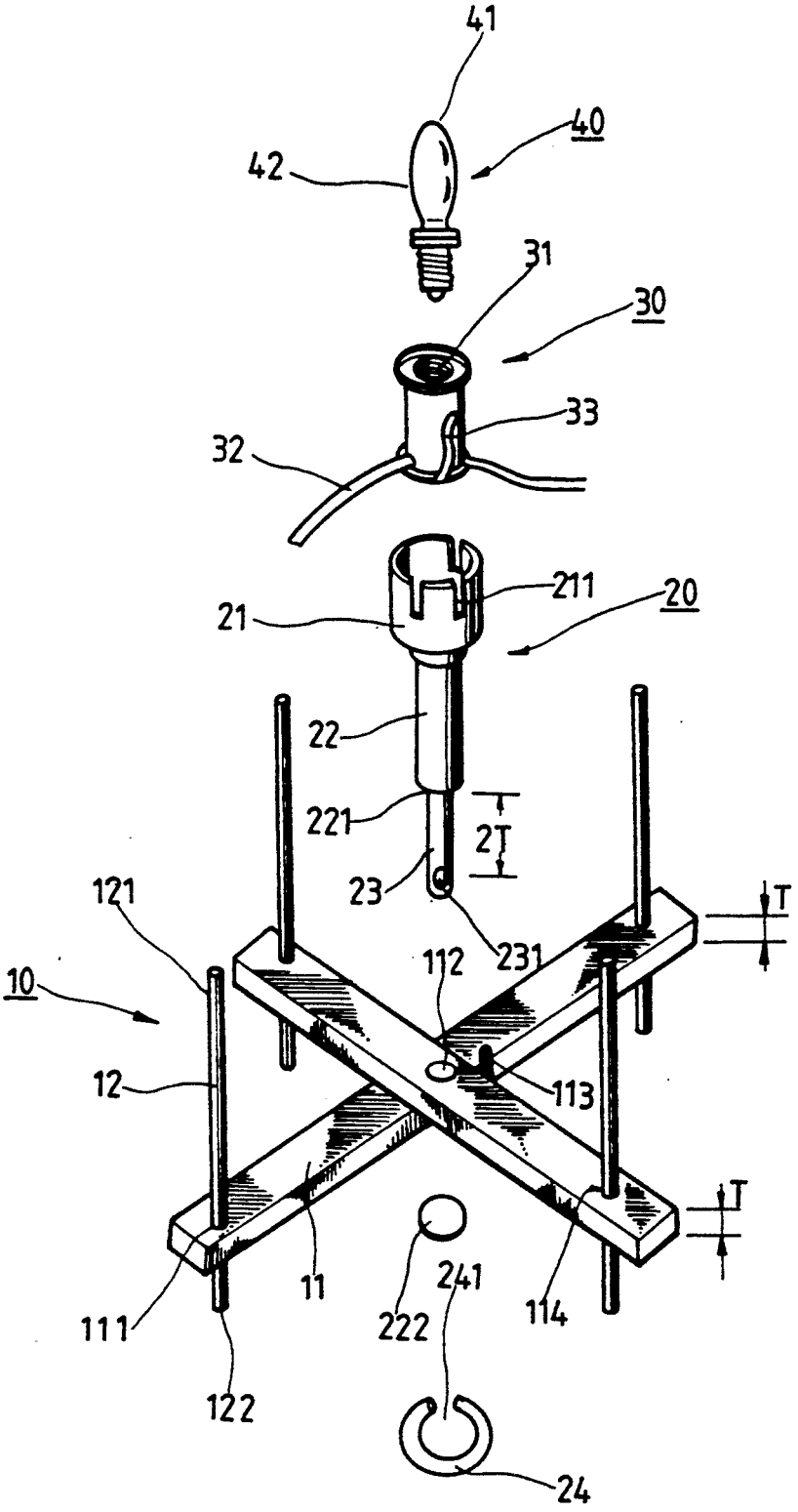
FIG. 1 is an exploded perspective showing the components which constitute the lantern of a preferred embodiment of the present invention.

Now referring to FIG. 1, the first embodiment of the foldable lantern of the present invention. The lantern having a crossed frame 10 composed of a pair of flat base members 11-11, which are pivotally joined through their central holes 112-112 with a reduced diameter section 23 of a downwardly extended center post 22 of a relatively greater diameter. At the lower end of the reduced diameter pivot 23, a through hole 231 is provided to receive a pair of end 241 of a hanger ring 24 which is functioned to serve as a hanger when the lantern is desired to be hung up-side-down. The center post 22 with its junction 221 to the reduced section 23 acting as a retaining flange and incorporated with a washer 222 disposed at lower end of section 23 just above the through hole 23. The section retained between flange 221 and the upper surface of the washer 222 having a length of 2T which is twice of the thickness T of each base member 11 performs the function as a pivot shaft to the crossed base members 11-11, so that the frame 10 of the lantern becomes extendible and foldable.

At each end of the member 11, a corner hole 111 is provided to let through of a corner post 12 which extends upward beyond the base member 11 as tightener 121 for a tent 50 (FIG. 3) and downwardly under said base member 11 as leg to make the upstanding of the lantern possible. Four legs 122 are well balanced and flexible to cope with a soft or even a rugged surface of the ground.

Alongside one of the member 11 at a position of the crossing, a pin-like stopper 113 is made adhered thereon to prevent the members from over extending to exceed the predetermined position.

The center post 22 extends further upward to become a lamp socket holder 21 where three bolts 211 are provided circumferentially to let out respectively a pair of conductors and a hook readily provided on a lamp socket 30 when the socket is received in the holder 21. The lamp socket 30 is to take a lamp bulb 40 having a bulb proper 41 and a screw threaded base 42.

Figure 2:
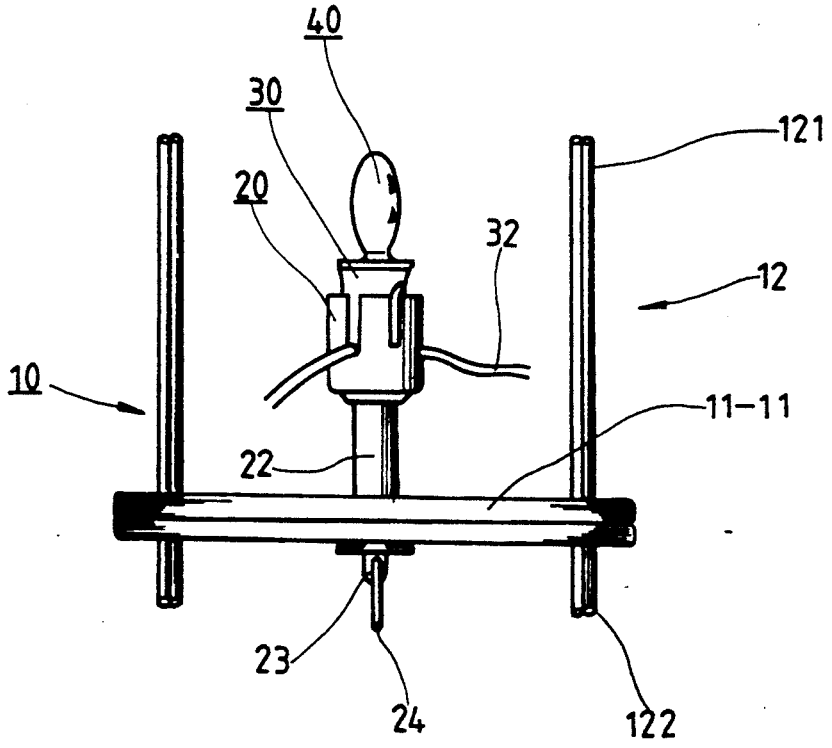
FIG. 2 is a front elevation of the said embodiment depicting the fold-up position of the lantern frame.

FIG. 2 depicts a folded -up position of the lantern frame which is shown in a front elevation.

Figure 3:
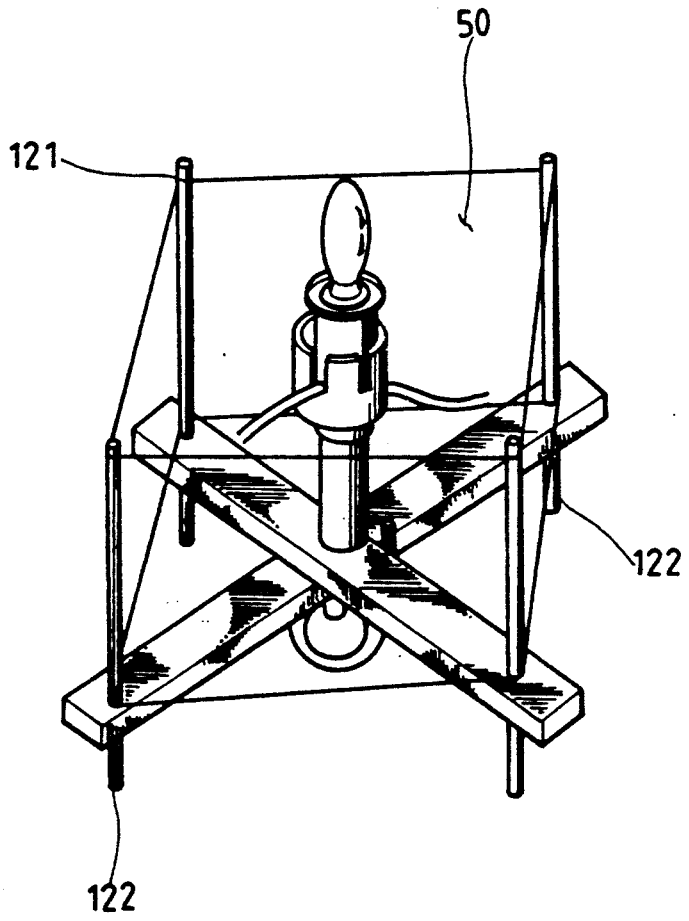
FIG. 3 is a perspective showing the lantern frame being in extended position with the tent wrapped around.

FIG. 3 is a perspective view showing the embodiment with tent 50 installed. The tent 50 is an endless loop of fabric which may be in any desired color and pattern design for the purpose of enhancing the festival atmosphere and bringing up the spirit of celebration. The tent 50 is changeable upon various occasion.

Figure 4:
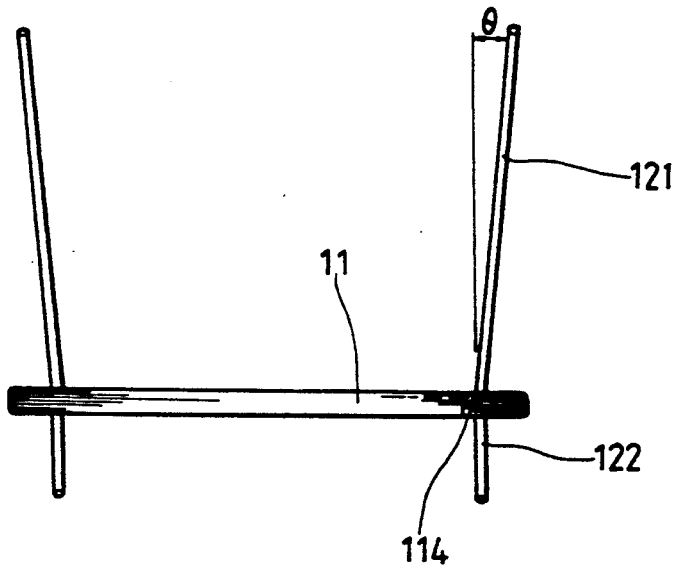
FIG. 4 is a schematic view showing the detail of a wedge inserted between the base member end hole and the corner post to assume the inclination of said post to get the tent tightened up.

FIG. 4 schematically shows a wedge means 114 being provided as an insert in the hole 111 between the tent tightening upper section 121 of the corner post 12 and the base member 11 to avoid the slackness of the tent resulted from fatigue or otherwise. An out tilting angle O is resulted from such an insertion of wedge means.

Figure 5:
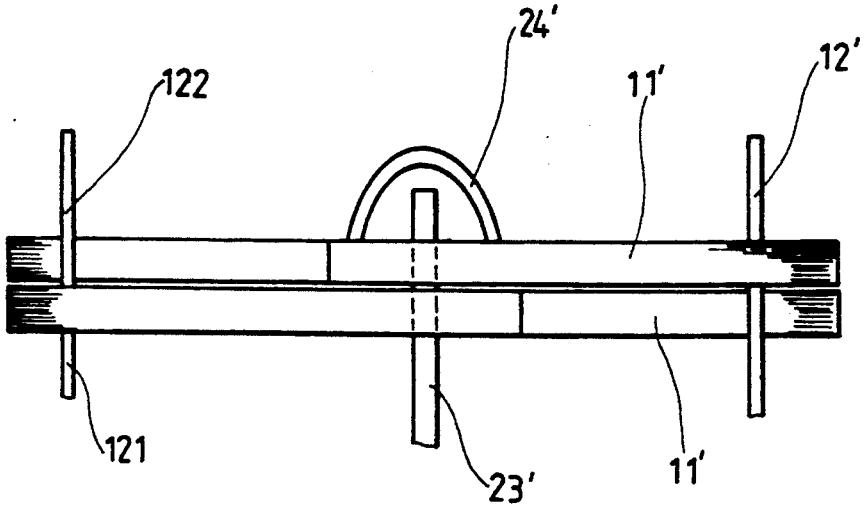
FIG. 5 is an up-side-down elevation of a lantern in folded position which depicts a second embodiment having Z shaped base members.
Figure 6:
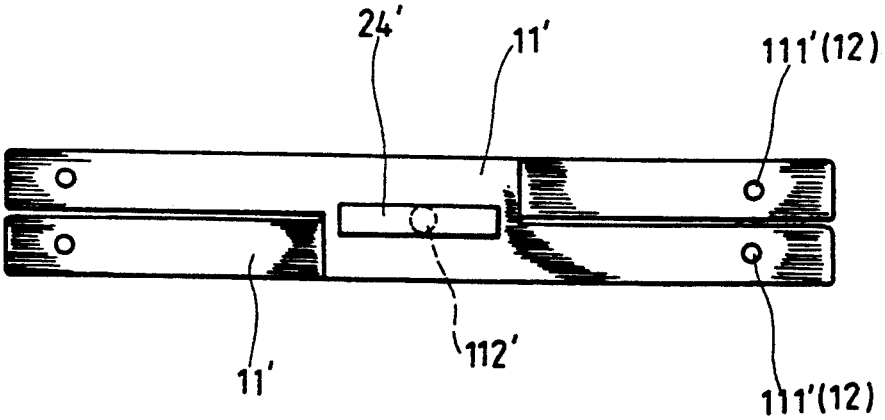
FIG. 6 is a bottom view showing said second embodiment.

FIGS. 5 and 6 depict a second embodiment of the frame of the foldable lantern of the present invention.

FIG. 5 is an up-side-down elevation of a second embodiment of the foldable lantern of the present invention where a hanger of inverted "V" shape is integrally formed with the base member 11'. Instead of being shown in FIG. 2, where corner posts 12-12 are seen juxtaposed. FIG. 5 gives an entirely different view where two corner posts are superimposed. This means can save space when the lantern frame 10 is folded up. This merit attributed to a different type of the crossed base member 11' as in the meantime shown in FIG. 6.

The base member 11' having a modified shape of "Z" rather than those in the first embodiment having a rectangular plan view. The "Z" shaped base member being stacked in a complimentary direction makes possible the four corner posts 12 superimposedly aligned without juxtaposing. Therefore the folded-up position takes less space and facilitates storage and shipment.

The present invention has been described by way of preferred embodiments which is for illustration and not limitation. Those skilled in the art may vary without departing from the scope of the present invention set forth in the annexed claims.

We claim:

1. A foldable lantern comprising a frame body (10) composed of two crossed base members (11) each having at its two ends respectively a corner post retaining hole (111) to take a corner post (12) and its middle a center post retaining hole (112) to take a reduced diameter section (23) of a center post (22) serving as a pivot to enable the two base members (11) to form an extendible and foldable lantern frame, the upper section of the center post (22) becoming a lamp holder (20) with a lamp socket (30) and a bulb (40) provided, and a tent or screen (50) being provided to wrap around the corner posts (111) to form said lantern.

2. Foldable lantern according to claim 1, wherein the pivotal center post (22) having its lower section (23) of reduced diameter inserted in a middle retaining holes (112) of the base members (11) with its enlarged diameter upper portion (221) served as a retaining flange which is to incorporate with a plate washer (222) provided adjacent the end of said lower section (23) to retain said section (23) to perform the pivotal function, a cross through hole (231) is disposed right under said plate washer (222) to take a pair of ends (241) of a hanger ring 24 to enable the lantern to be hung up-side-down.

3. Foldable lantern according to claim 2, wherein the upper end of the center post (22) has a socket retainer (21) formed integrally thereon which has slots (211), disposed spaced apart around the circumference to form a lamp holder (20), a lamp socket (30) having a bulb seat (31) with a pair of conductors (32) and a suspending hook held by said holder (20), and a light bulb (40) having a bulb proper (41) and a bulb base in turn fitted into said socket (30).

4. Foldable lantern according to claim 1, wherein a stopper means (113) is provided alongside one of the cross base member (111) to stop the said members from overextending to exceed a predetermined position.

5. Foldable lantern according to claim 1, where each corner post (12) held in corner hole (111) with its upper section (121) extending above the cross member (11) serving as a tent tightener to tighten the tent or screen (50) being wrapped around the four corner posts (12), the lower section (122) of the corner post (12) extending under the cross member (11) serves as legs of the lantern for upright standing.

6. Foldable lantern according to claim 5 wherein the tent tightening effect of the corner posts is furthered by providing a wedge (114) between each retaining hole (111) and each corner post (12) to cause outward inclination of said posts (12).

7. Foldable lantern according to claim 1, wherein each of the base member (11) has a rectangular plain view.

8. Foldable lantern according to claim 1, wherein each of the base member (11') has a "Z" shaped plain view.

9. Foldable lantern according to claim 1 wherein the hanger ring (24') is made into an inverted "V" shape and being integrally formed under the lower piece of the "Z" shaped base member (11').

10. Foldable lantern according to claim 1, wherein the tent is made in the form of an endless loop with desired color and provided with desired pattern designed to meet various occasions.

* * * * *